US008915270B2

(12) United States Patent
Fogg

(10) Patent No.: US 8,915,270 B2
(45) Date of Patent: Dec. 23, 2014

(54) FILLER DEVICE HAVING AN ENCLOSURE SUB-ASSEMBLY

(75) Inventor: Benjamin Fogg, Holland, MI (US)

(73) Assignee: Fogg Filler Company, Holland, MI (US)

( * ) Notice: Subject to any disclaimer, the term of this patent is extended or adjusted under 35 U.S.C. 154(b) by 665 days.

(21) Appl. No.: 12/924,791

(22) Filed: Oct. 5, 2010

(65) Prior Publication Data

US 2012/0175017 A1 Jul. 12, 2012

Related U.S. Application Data

(60) Provisional application No. 61/248,656, filed on Oct. 5, 2009.

(51) Int. Cl.
*B65B 43/42* (2006.01)
*B67C 3/22* (2006.01)
*B65B 59/04* (2006.01)

(52) U.S. Cl.
CPC .. *B67C 3/22* (2013.01); *B65B 59/04* (2013.01)
USPC ..... 141/144; 141/135; 141/163

(58) Field of Classification Search
USPC ..... 141/129, 144, 135, 163
See application file for complete search history.

(56) References Cited

U.S. PATENT DOCUMENTS

| | | | | |
|---|---|---|---|---|
| 3,868,153 | A * | 2/1975 | Sholtes | 312/236 |
| 4,732,432 | A * | 3/1988 | Keil et al. | 312/406.2 |
| 5,141,300 | A * | 8/1992 | Ciesla | 312/204 |
| 5,485,733 | A * | 1/1996 | Hoffman | 70/276 |
| 8,479,782 | B2 * | 7/2013 | Mastio et al. | 141/89 |
| 2003/0205953 | A1 * | 11/2003 | Fox | 312/216 |

* cited by examiner

*Primary Examiner* — Jason K Niesz
(74) *Attorney, Agent, or Firm* — King & Partners, PLC

(57) ABSTRACT

Filler devices having an enclosure sub-assembly are provided herein. Filler devices may include at least one of a reservoir and at least one working valve for dispensing the product into a container. Enclosure sub-assemblies may include an enclosure frame, an enclosure member, at least one hinge, and at least one magnetic latch assembly, wherein the at least one magnetic latch assembly comprises a body having a magnet associated therewith, and wherein the at least one magnetic latch assembly is fixedly secured to one of the enclosure frame or the enclosure member upon displacement of the enclosure member from a closed position to an open position, and releasably, magnetically secured to the other of the enclosure frame or the enclosure member upon displacement of the enclosure member from a closed position to an open position.

6 Claims, 6 Drawing Sheets

FILLER DEVICE HAVING AN ENCLOSURE SUB-ASSEMBLY

CROSS-REFERENCE TO RELATED APPLICATION(S)

This application claims the benefit of U.S. Provisional Application Ser. No. 61/248,656, filed Oct. 5, 2009, entitled "FILLER DEVICE HAVING AN ENCLOSURE SUB-ASSEMBLY," which is hereby incorporated herein by reference in its entirety, including all references cited therein.

BACKGROUND OF THE INVENTION

1. Field of the Invention

The present invention relates in general to a filler device and, more particularly, to a filler device having an enclosure sub-assembly.

2. Background Art

Filler devices and associated sub-assemblies have been known in the art for years and are the subject of numerous patents including: U.S. Pat. No. 6,889,482, U.S. Pat. No. 6,810,636, U.S. Pat. No. 6,786,248, U.S. Pat. No. 6,725,633, U.S. Pat. No. 6,655,109, U.S. Pat. No. 6,508,046, U.S. Pat. No. 6,338,370, U.S. Pat. No. 6,305,437, U.S. Pat. No. 6,152,195, U.S. Pat. No. 5,975,159, U.S. Pat. No. 4,979,607, U.S. Pat. No. 4,567,919, and U.S. Pat. No. 4,269,236—all of which are hereby incorporated herein by reference in their entirety including the references cited therein.

While filler devices have been known in the art for years, to the best of Applicant's knowledge, such filler devices include enclosure sub-assemblies, which utilize conventional, mechanical latching mechanisms. To be sure, filler devices which comprise such a configuration are replete with significant drawbacks, including, but not limited to high manufacturing, maintenance, installation and repair costs—just to name a few.

It is, therefore, an object of the present invention to provide a filler device having an enclosure sub-assembly, which reduces and/or eliminates the aforementioned drawbacks associated with present device configurations.

These and other objects of the present invention will become apparent in light of the present specification, claims, and drawings.

SUMMARY OF THE INVENTION

The present invention is directed to a filler device (e.g., a linear, inline, rotary filler), comprising: (a) a reservoir for containing a product and/or a direct supply of a product; (b) a working valve for dispensing the product into one or more container(s); and (c) an enclosure sub-assembly associated with at least a portion of the filler device, comprising: (1) an enclosure frame, wherein the enclosure frame comprises one or more inner surface(s) and one or more outer surface(s), and wherein an aperture is formed by the inner surface(s); (2) an enclosure member, wherein the enclosure member comprises a peripheral geometry which substantially conforms to the aperture formed by the inner surface(s) of the enclosure frame; (3) one or more hinge(s), wherein the hinge(s) are associated with the enclosure frame and the enclosure member, and wherein the hinge(s) facilitate controlled displacement of the enclosure member between open and closed positions; and (4) one or more magnetic latch assemblies, wherein the magnetic latch assemblies comprise a body having a magnet associated therewith, and wherein the magnetic latch assemblies are fixedly secured to the enclosure frame or the enclosure member upon displacement of the enclosure member from a closed position to an open position, and releasably, magnetically secured to the other of the enclosure frame or the enclosure member upon displacement of the enclosure member from a closed position to an open position.

In a preferred embodiment of the present invention, the filler device comprises a reservoir for containing the product and/or a plurality of working valves for dispensing the product into a plurality of containers.

In another preferred embodiment of the present invention, the enclosure frame comprises four inner surfaces which collectively form a generally rectangular aperture.

In yet another preferred embodiment of the present invention, the enclosure member comprises a window or door.

In another aspect of the present invention, the one or more hinge(s) comprise two hinges which are rotatable about a single axis upon displacement of the enclosure member from a closed position to an open position.

In a preferred embodiment of the present invention, the enclosure member comprises one or two magnetic latch assemblies which are magnetically secured to at least a portion of the enclosure frame when the enclosure member is displaced from an open position to a closed position.

In another preferred embodiment of the present invention, the body of the magnetic latch assembly comprises a cavity adapted to retain a magnet therein. In this embodiment the magnetic latch assembly preferably includes a substantially planar bottom surface, and an intermediate surface and a top surface, which collectively form a step.

In yet another preferred embodiment of the present invention, the filler device further comprises a strike plate positioned between the enclosure frame and the magnetic latch assembly.

In another aspect of the preferred embodiment of the present invention, the magnet comprises a rare earth magnet, such as a neodymium alloy, and more specifically comprises $Nd_2Fe_{14}B$.

In one embodiment, the present invention is directed to a filler device, comprising: (a) at least one of a reservoir for containing a product and a direct supply of a product; (b) a working valve for dispensing the product into a container; and (c) an enclosure sub-assembly associated with at least a portion of the filler device, comprising: (1) an enclosure frame defining an aperture, the enclosure frame having a substantially planar outer surface and at least one magnetic strike plate; (2) an enclosure member, wherein the enclosure member comprises an outer peripheral geometry which substantially conforms to the aperture of the enclosure frame, the enclosure member being pivotally coupled to the enclosure frame to facilitate controlled displacement of the enclosure member between open and closed positions; and (3) at least one magnetic latch assembly having a body that includes a substantially planar bottom surface and a thickening having at least one cavity for retaining a magnet, the at least one magnetic latch assembly being coupled to an outer surface of the enclosure member such that the magnetic object is positioned outside the outer peripheral geometry of the enclosure member and contacts the at least one magnetic strike plate to releaseably secure the enclosure member to the enclosure frame.

In an additional embodiment, the at least one magnetic latch assembly contacts the at least one magnetic strike plate to releaseably secure the enclosure member to the enclosure frame, the front surface of the enclosure member is disposed in a substantially co-planar relationship to a front surface of the enclosure frame.

In yet another embodiment, the cavity has a depth such that when the magnetic latch assembly contacts the at least one magnetic strike plate a portion of the body is positioned between the magnet and the at least one magnetic strike plate.

According to some embodiments, the at least one magnetic latch assembly includes a body having a first thickness and a second thickness that is greater than the first thickness, wherein the second thickness includes a cavity for retaining at least a portion of a magnet.

In additional aspects the present invention may include the at least one magnetic latch assembly having two magnets disposed in separate cavities that are in a spaced apart relationship to one another.

In other embodiments, the present invention may be directed to an enclosure sub-assembly for a filler device, comprising: (a) an enclosure frame, wherein the enclosure frame comprises at least one inner surface and at least one outer surface, and wherein an aperture is formed by the at least one inner surface; (b) an enclosure member, wherein the enclosure member comprises a peripheral geometry which substantially conforms to the aperture formed by the at least one inner surface of the enclosure frame; (c) at least one hinge, wherein the at least one hinge is associated with the enclosure frame and the enclosure member, and wherein the at least one hinge facilitates controlled displacement of the enclosure member between open and closed positions; and (d) at least one magnetic latch assembly, wherein the at least one magnetic latch assembly comprises a body having a magnet associated therewith, and wherein the at least one magnetic latch assembly is fixedly secured to one of the enclosure frame or the enclosure member upon displacement of the enclosure member from a closed position to an open position, and releasably, magnetically secured to the other of the enclosure frame or the enclosure member upon displacement of the enclosure member from a closed position to an open position.

BRIEF DESCRIPTION OF THE DRAWINGS

Certain embodiments of the present invention are illustrated by the accompanying figures. It will be understood that the figures are not necessarily to scale and that details not necessary for an understanding of the invention or that render other details difficult to perceive may be omitted. It will be understood that the invention is not necessarily limited to the particular embodiments illustrated herein.

The invention will now be described with reference to the drawings wherein.

DETAILED DESCRIPTION OF THE INVENTION

Figure 1:
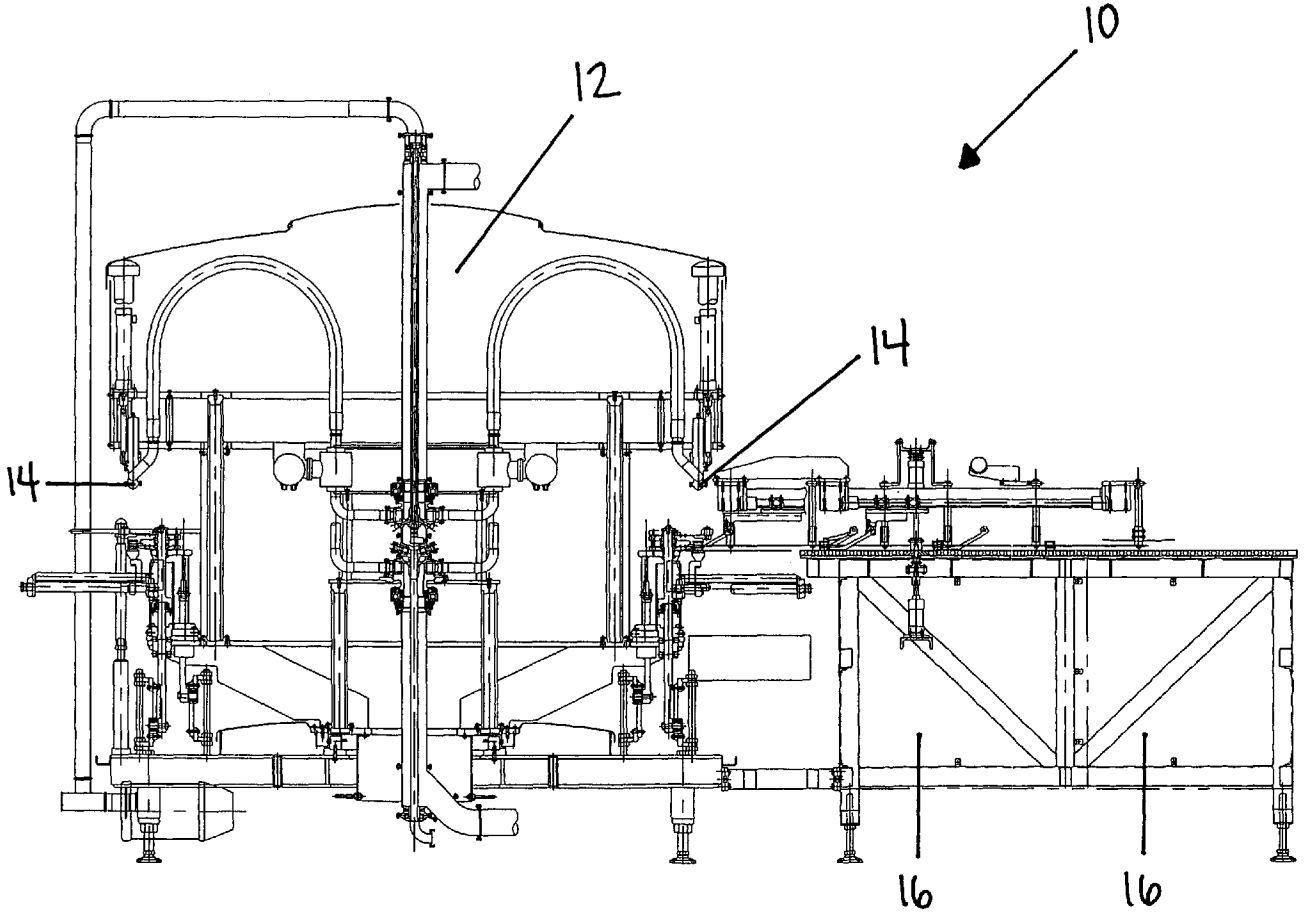
FIG. 1 of the drawings is a perspective view of a filler device fabricated in accordance with the present invention.

While this invention is susceptible of embodiment in many different forms, there is shown in the drawings and will herein be described in detail several specific embodiments with the understanding that the present disclosure is to be considered as an exemplification of the principles of the invention and is not intended to limit the invention to the embodiments illustrated.

It will be understood that like or analogous elements and/or components, referred to herein, may be identified throughout the drawings with like reference characters.

Referring now to FIG. 1, filler device 10 is shown as generally comprising reservoir 12 for containing a product, one or more working valves 14 for dispensing the product into a container, and enclosure sub-assembly 16 associated with at least a portion of the filler device.

In accordance with the present invention, filler device 10 may comprise a rotary filler, an inline filler, a linear filler, as well as other filler device configurations that would be known to those with ordinary skill in the art having the present disclosure before them.

For purposes of the present disclosure reservoir 12 may gravity feed product to working valve 14. Alternatively, product may be directly supplied or pumped from reservoir 12 to working valve 14.

It will be understood that reservoir 12 of filler device 10 may contain food products, and/or non-food products in gas, liquid, semi-solid, solids, and/or any displaceable phase. Preferred products include, for example, water, soda, fruit and/or vegetable juices, milk, alcohols, purèed substances, ground substances, small particle food and non-food products, etcetera.

In accordance with the present invention, working valve 14 may comprise, for example, those disclosed in U.S. Pat. No. 6,786,248, U.S. Pat. No. 6,338,370, U.S. Pat. No. 5,878,992, U.S. Pat. No. 5,402,833, U.S. Pat. No. 4,219,054, and U.S. Pat. No. 4,848,381—all of which are hereby incorporated herein by reference in their entirety including the references cited therein. Dispensing valves of the present invention are commercially available from Fogg Filler Company of Holland, Mich.

Figure 2:
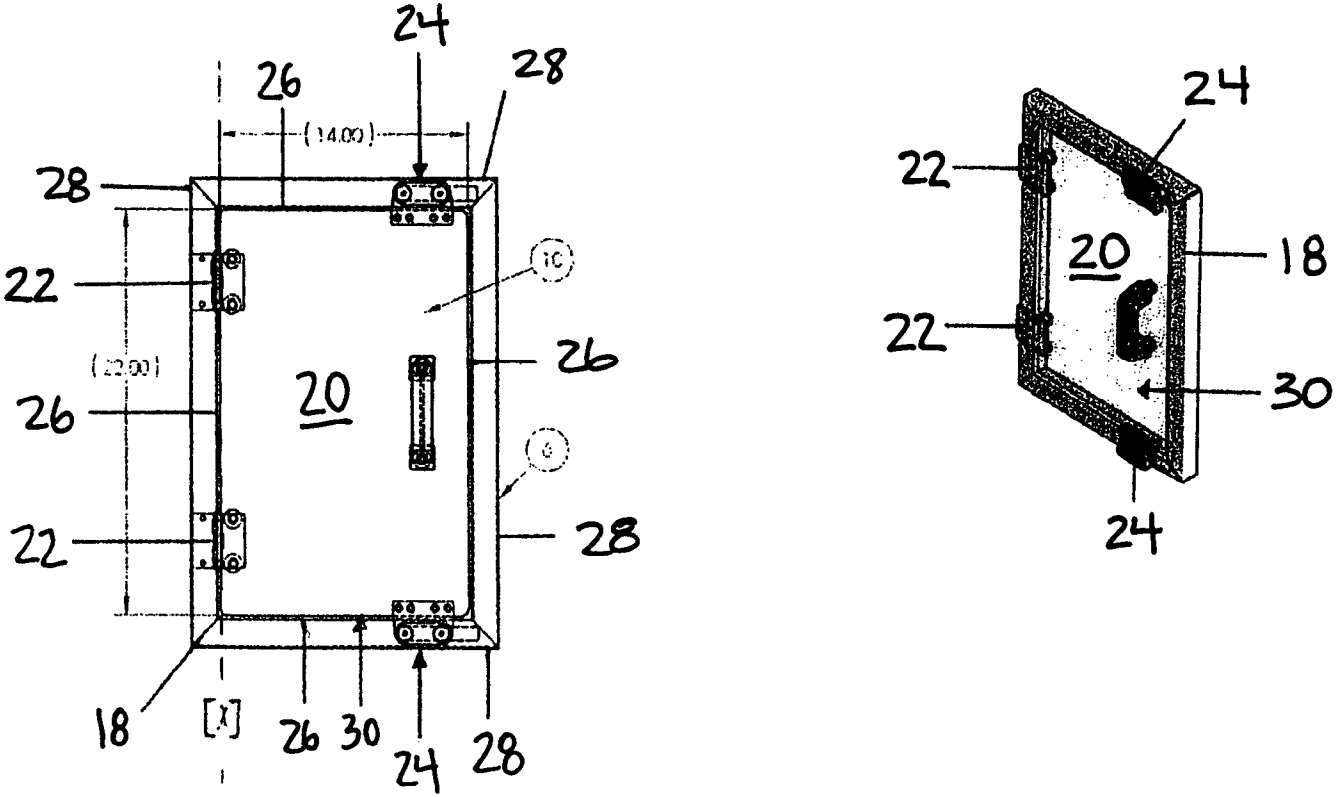
FIG. 2 of the drawings is a perspective view of a portion of an enclosure sub-assembly fabricated in accordance with the present invention.
Figure 3:
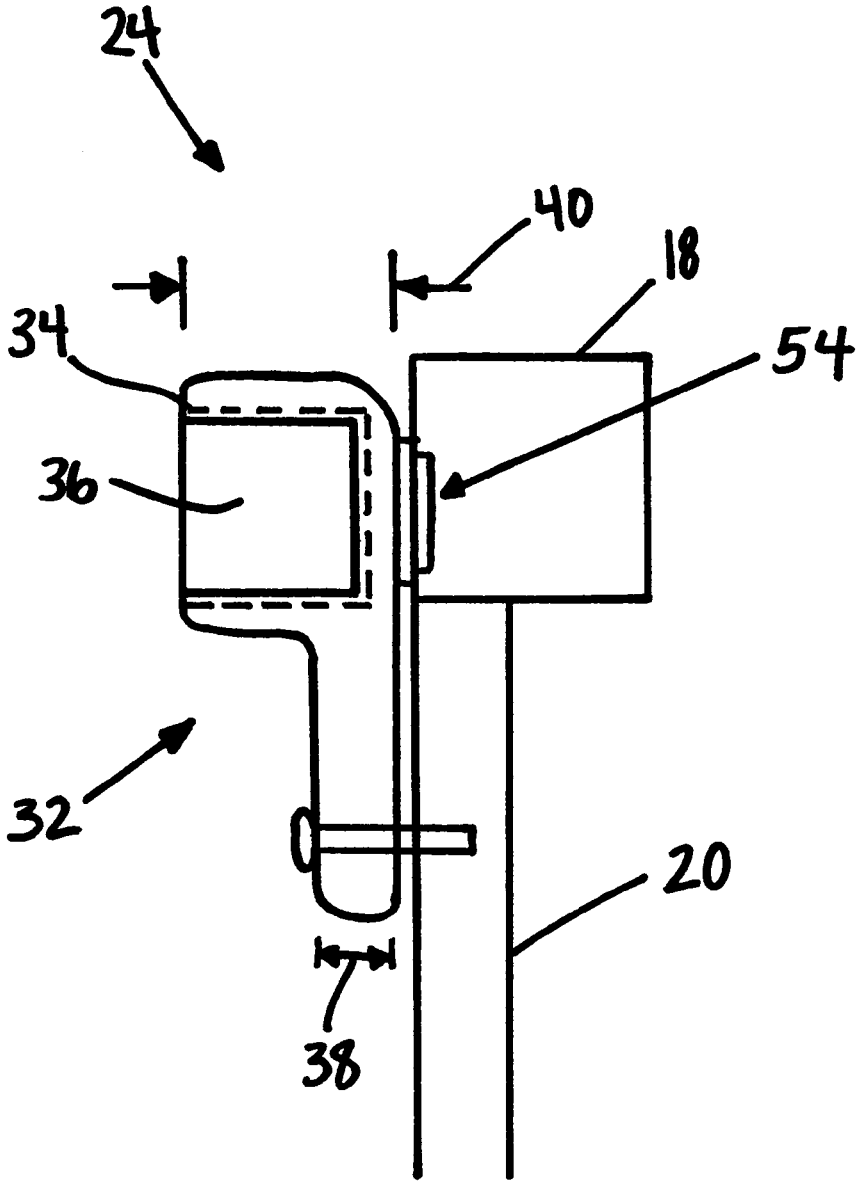
FIG. 3 of the drawings is a partial cross-sectional view of a magnetic latch assembly fabricated in accordance with the present invention.

Referring now to FIGS. 2 and 3 collectively, enclosure sub-assembly 16 generally comprises enclosure frame 18, enclosure member 20, hinge 22, and magnetic latch assembly 24.

For purposes of the present disclosure, enclosure frame 18 preferably comprises inner surfaces 26 and outer surfaces 28. Inner surfaces 26 collectively form aperture 30. It will be understood that in some embodiments, enclosure frame 18 may comprise four inner surfaces, which collectively form a generally rectangular aperture. While enclosure frame 18 has been disclosed as having a generally rectangular configuration, one of ordinary skill in the art will appreciate that enclosure frame 18 may include may other configurations such as circular, square, polygonal, and the like.

Enclosure member 20 comprises an outer peripheral geometry, which substantially conforms to aperture 30 formed by inner surfaces 26 of enclosure frame 18. Non-limiting examples of enclosure member 20 may include, for example, a window, a door, etcetera.

In accordance with the present invention, enclosure member 20 may be pivotally coupled to enclosure frame 18. In some embodiments, hinge 22 may pivotally couple enclosure frame 18 and enclosure member 20, and facilitate controlled displacement of enclosure member 20 between open and closed positions. According to some embodiments, enclosure member 20 and enclosure frame 18 may be pivotally coupled via a pair of hinges 22 that pivot about a single axis (X) to facilitate displacement of enclosure member 20 from a closed position to an open position and vice versa.

Figure 4:
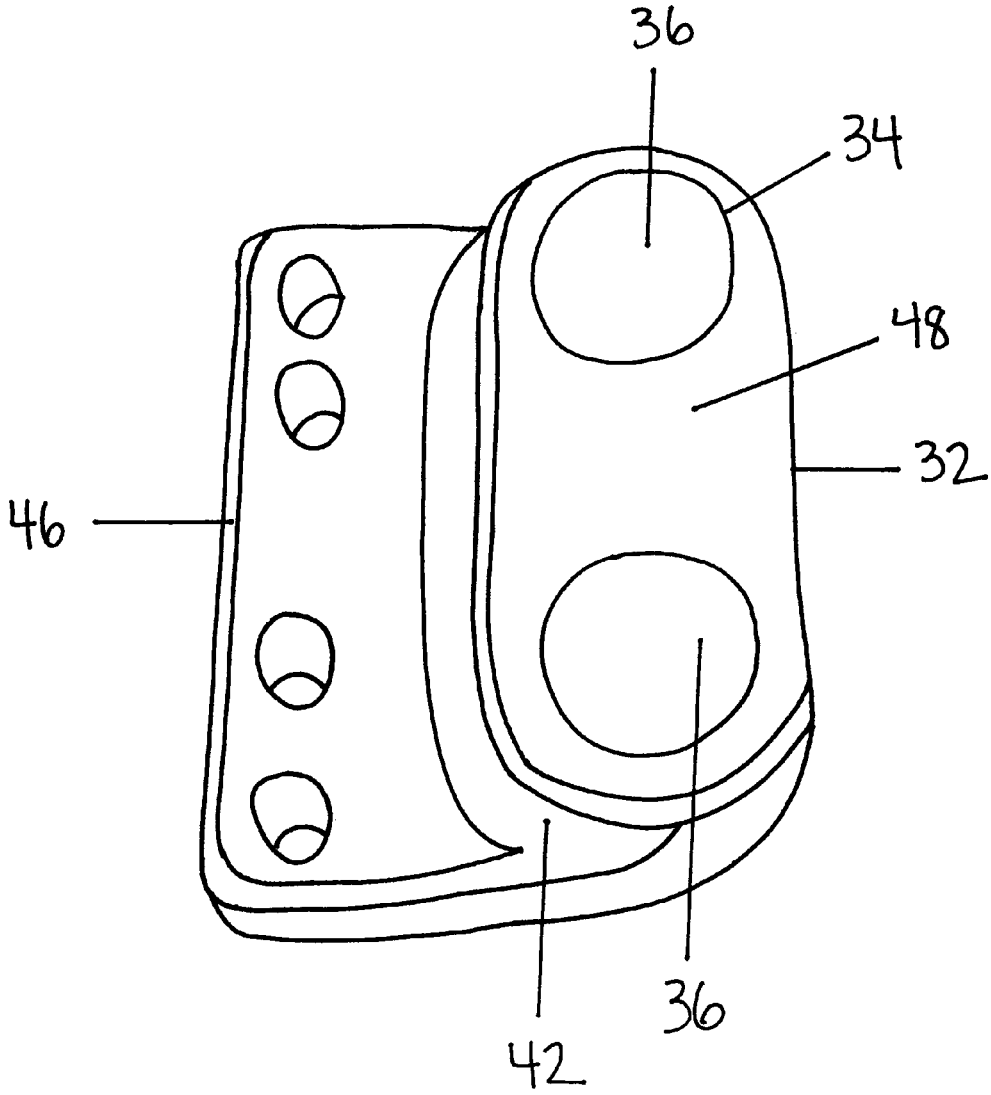
FIG. 4 of the drawings is a top perspective view of a magnetic latch assembly fabricated in accordance with the present invention.
Figure 5:
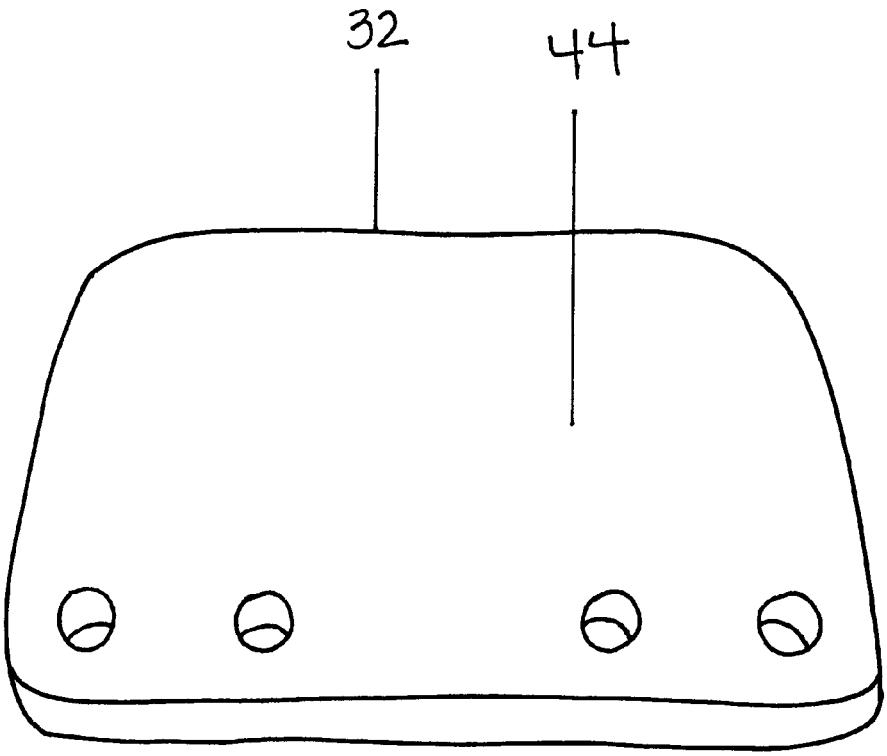
FIG. 5 of the drawings is a bottom perspective view of the magnetic latch assembly of FIG. 4, fabricated in accordance with the present invention.

As is best shown in FIGS. 4 and 5 collectively, magnetic latch assembly 24 comprises body 32 having cavity 34 for retaining magnet 36. Body 32 may be fabricated from a substantially non-magnetic material such as a plastic, a resin, a natural material (e.g., wood, rubber, etc.), a composite, or any combination thereof. Body 32 may be fabricated to include first thickness 38 and second thickness 40. According to some embodiments, second thickness 40 is greater than first thickness 38 to define step 42.

In accordance with the present disclosure, it will be understood cavity 34 may be located on second thickness 40 and the size and depth of cavity 34 may depend upon the proportions of magnet 36. Moreover, in some embodiments, cavity 34 does not extend entirely through second thickness 40 such that at least a portion of body 32 disposed below magnet 36 remains. As such, magnet 36 may be preferably capable of producing a magnetic field of sufficient strength to exert magnetic forces through the portion of second thickness 40 disposed below magnet 36 to magnetically couple magnet 36 with a magnetic strike plate as will be discussed in greater detail infra. Also, in some embodiments, second thickness 40 includes two cavities 34 disposed in spaced apart relationship to one another, each of the two cavities 34 having a magnet associated therewith.

In accordance with the present invention, body 32 of magnetic latch assembly 24 may include substantially planar bottom surface 44, as well as intermediate surface 46 and front surface 48.

The substantially planar configuration of bottom surface 44 allows body 32 to be attached to the front surface of enclosure member 20 such that the front surface of enclosure member 20 is substantially flush with the front surface of enclosure member 20. Moreover, magnets 36 are positioned at least partially outside outer peripheral geometry of enclosure member 20, and in some embodiments magnets 36 are positioned completely outside the outer peripheral geometry of enclosure member 20.

In accordance with the present invention, body 32 may be fixedly attached to enclosure member 20 via fasteners extending through apertures fabricated along and through first thickness 38. In accordance with the present disclosure, magnetic latch assembly 24 may include two magnetic latch assemblies, which are fixedly secured to enclosure member 20.

Preferably magnet 36 of the present invention comprises a rare earth magnet, such as a neodymium alloy, including but not limited to $Nd_2Fe_{14}B$, although other types of magnets capable of exerting forces sufficient to magnetically secure enclosure member 20 within aperture 30 of enclosure frame 18 that would be known to one of ordinary skill in the art with the present disclosure before them are likewise contemplated for use in accordance with the present invention.

Referring also to FIG. 2, filler device 10 may also comprise magnetic strike plate 52 positioned between enclosure frame 18 and magnetic latch assembly 24 for releaseably securing enclosure member 20 to enclosure frame 18. According to some embodiments, at least a portion of magnetic strike plate 52 may be recessed into enclosure frame 18. It is noteworthy that if enclosure frame 18 is constructed of a magnetic material, magnetic strike plate 52 may not be required.

Upon displacement of enclosure member 20 from an open position to a closed position, magnets 36 of body 32 and magnetic strike plate 52 are disposed in face-to-face relationship such that magnets 36 of body 32 and magnetic strike plate 52 are magnetically secured together. Furthermore when enclosure member 20 is displaced to the closed position, the front surface of enclosure member 20 and the front surface of enclosure frame 18 are substantially co-planar to one another.

According to additional embodiments, magnetic strike plate 52 may include an electromagnetic assembly (not shown) which generates approximately 1,200 lbf (pound force) to lock magnets 36 of body 32 and magnetic strike plate 52 together. Application of an electric current through at least one of magnets 36 of body 32 and magnetic strike plate 52 locks magnets 36 and magnetic strike plate 52 together. Cessation of the electric current therethrough removes the force generated by the magnet such that displacement of enclosure member 20 separates magnetic latch assembly 24 and magnetic strike plate 52.

Figure 6:
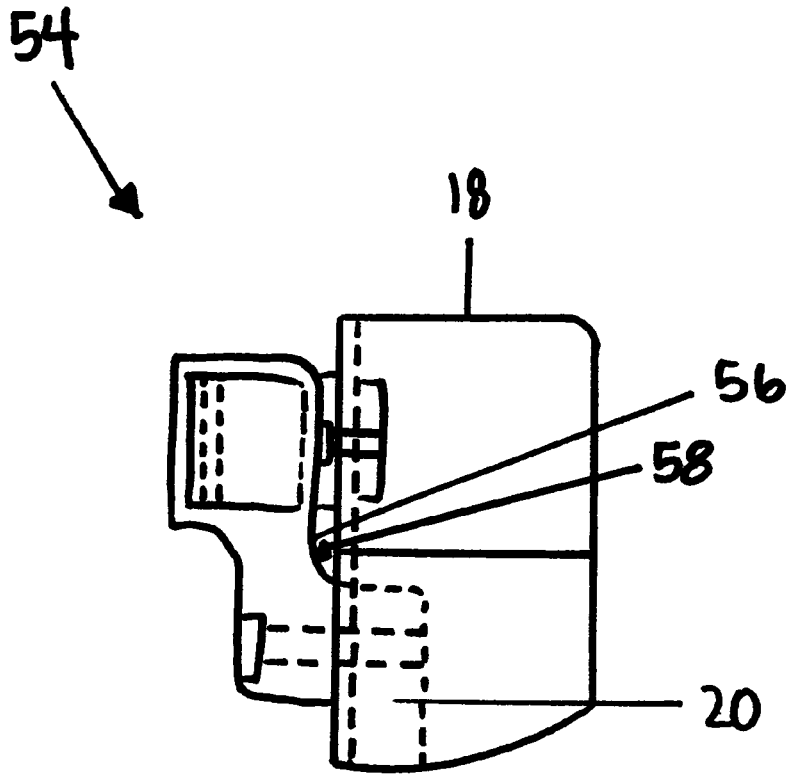
FIG. 6 of the drawings is a partial cross-sectional view of an alternate magnetic latch assembly fabricated in accordance with the present invention.

Referring now to FIG. 6, shown therein is an alternative embodiment of magnetic latch assembly 54 constructed similarly to magnetic latch assembly 24 having a modified bottom surface 56. Rather than being substantially planar, bottom surface 56 may include offset 58. With the addition of offset 58, the front surface of enclosure member 20 may be substantially non-coplanar with the front surface of enclosure frame 18.

The foregoing description merely explains and illustrates the invention, and the invention is not limited thereto except insofar as the appended claims are so limited, as those skilled in the art who have the disclosure before them will be able to make modifications without departing from the scope of the invention.

What is claimed and desired to be secured by Letters Patent of the United States is:

1. A filler device, comprising:

at least one of a reservoir for containing a product and a direct supply of a product;

a working valve for dispensing the product into a container; and an enclosure sub-assembly associated with at least a portion of the filler device, comprising:

an enclosure frame defining an aperture, the enclosure frame having a substantially planar outer surface and at least one magnetic strike plate;

an enclosure member, wherein the enclosure member comprises an outer peripheral geometry which substantially conforms to the aperture of the enclosure frame, the enclosure member being pivotally coupled to the enclosure frame to facilitate controlled displacement of the enclosure member between open and closed positions; and at least one magnetic latch assembly having a body that includes a first thickening and a second thickening, the second thickening having at least one cavity for retaining a magnet, the at least one magnetic latch being coupled to an outer surface of the enclosure member such that the magnetic object is positioned outside the outer peripheral geometry of the enclosure member and is adapted to contact the at least one magnetic strike plate to releaseably secure the enclosure member to the enclosure frame when the enclosure member is in the closed position.

2. The filler device according to claim 1, wherein when the at least one magnetic latch assembly contacts the at least one magnetic strike plate to releaseably secure the enclosure member within the aperture of the enclosure frame, the front surface of the enclosure member is disposed in a substantially co-planar relationship to a front surface of the enclosure frame.

3. The filler device according to claim 1, wherein the second thickness is greater than the first thickness, the first and second thicknesses defining a step.

4. The filler device according to claim 1, wherein the cavity has a depth such that when the magnetic latch assembly contacts the at least one magnetic strike plate a portion of the body is positioned between the magnet and the at least one magnetic strike plate.

5. The filler device according to claim 1, wherein the at least one magnetic latch assembly includes two magnets disposed in separate cavities, the cavities being disposed in spaced apart relationship to one another.

6. The filler device according to claim 1, wherein at least one of the magnetic latch assembly and the magnetic strike plate include an electromagnet capable of magnetically locking the magnetic latch assembly and the magnetic strike plate together upon application of a current.

* * * * *